US005791260A

United States Patent [19]

Mack et al.

[11] Patent Number: 5,791,260

[45] Date of Patent: Aug. 11, 1998

[54] WORKTABLE FOR AN IN PARTICULAR MEDICAL OR DENTAL LABORATORY

[75] Inventors: Karl Mack, Leutkirch; Alfred Straka, Isny, both of Germany

[73] Assignee: Kaltenbach & Voigt GmbH, Biberach, Germany

[21] Appl. No.: 670,241

[22] Filed: Jun. 17, 1996

[30] Foreign Application Priority Data

Jun. 19, 1995 [DE] Germany ..... 195 22 183.4

[51] Int. Cl.[6] ..... A47B 35/00

[52] U.S. Cl. ..... 108/50.11; 108/161

[58] Field of Search ..... 108/50, 90, 161, 108/50.11

[56] References Cited

U.S. PATENT DOCUMENTS

| | | | |
|---|---|---|---|
| 2,175,572 | 10/1939 | Ruhl | 108/90 |
| 4,892,043 | 1/1990 | Schulz | 108/90 |
| 5,085,154 | 2/1992 | Merl | 108/90 |

FOREIGN PATENT DOCUMENTS

3328919 C1 11/1984 Germany .

3420567 A1 12/1985 Germany .

*Primary Examiner*—Jose V. Chen

*Attorney, Agent, or Firm*—Scully, Scott, Murphy & Presser

[57] ABSTRACT

In a worktable (1) for an in particular medical or dental laboratory, having a work station (7) on the forward region of its tabletop (2), at which a working device (5) is arranged, which is moveable on a guide framework (12, 13, 14) between an in-use position located above the tabletop (2) and a not-in-use position arranged under the table surface (2*a*), the guide framework has a carrier arm (12) arranged under the tabletop (2) extending approximately horizontally, which arm is mounted in its rear region pivotably on the worktable (1), around pivot axis (17*a*) extending horizontally and transversely. A guide element (24) is provided at a spacing forwardly from the pivot axis (17*a*) which guide element is displaceably guided in a guide path (14) that extends from a rear guide path end initially approximately horizontally (14*a*) forwardly and then in particular curvedly extends upwardly (14*b*), whereby the guide element (24) is positionable in the upper region of the guide path and whereby the carrier arm (12) is telescopable in the region between the pivot axis (17*a*) and the guide element (24) or is guided at its rear end in a further, horizontally extending guide (13, 16).

14 Claims, 4 Drawing Sheets

WORKTABLE FOR AN IN PARTICULAR MEDICAL OR DENTAL LABORATORY

Figure 1:
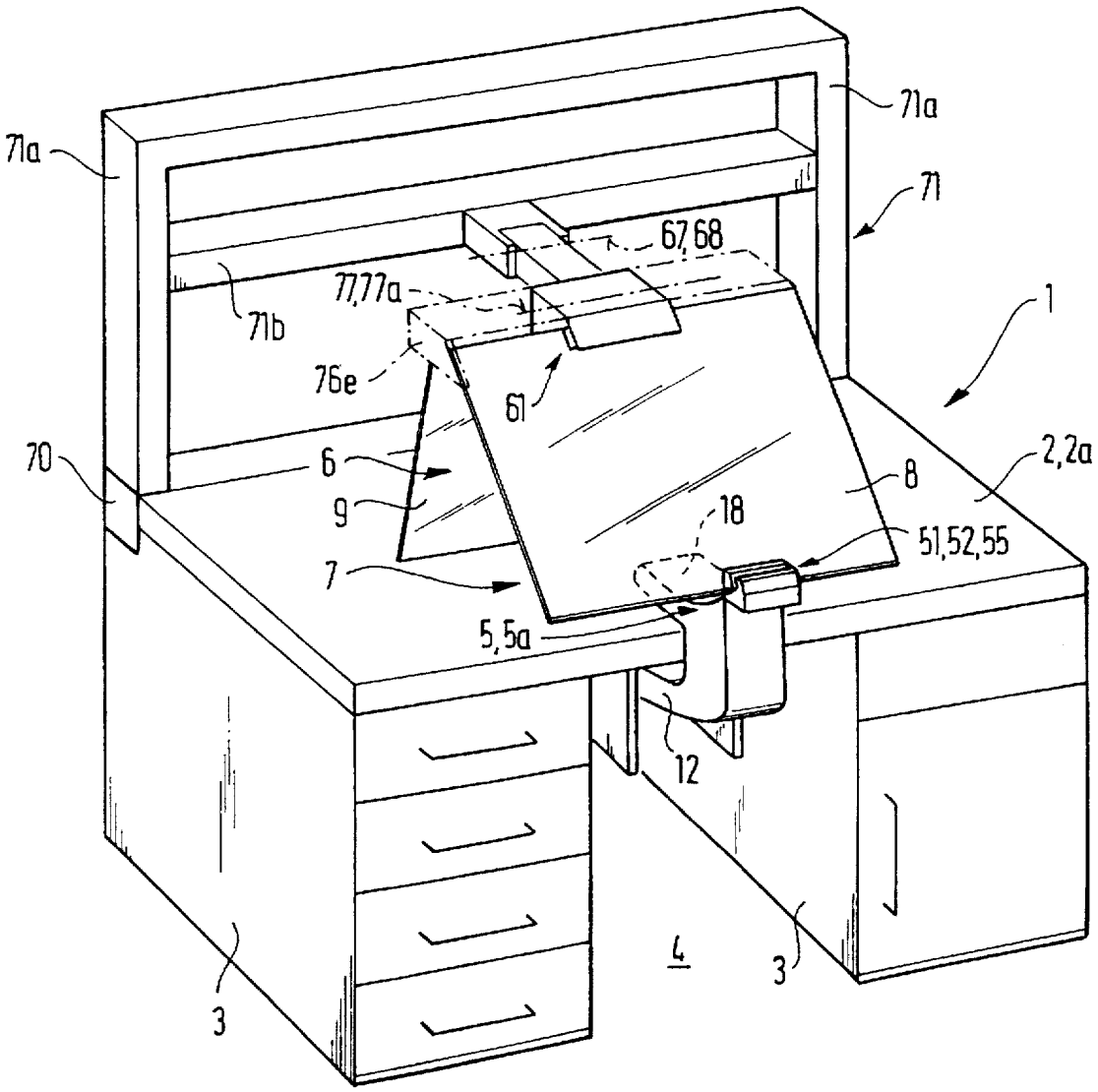

The invention relates to a worktable in accordance with the preamble of claim 1.

A worktable of this kind is described in DE 33 28 919 C1 in several configuration variants. With these known configurations, a suction head is arranged moveably between an in-use position located over the table surface of the worktable and a not-in-use position which is displaced downwardly relative to the in-use position. Thereby, the suction head is connected with a vacuum source by means of a suction line which is variable in its length, for the purpose of sucking away material to be exhausted which impinges upon the suction mouth of the suction head.

With several of the previously described configuration variants the suction head is held on a guide framework in the form of a jointed quadrilateral, whereby in accordance with FIGS. 9 to 12 of the above-mentioned publication a base part of the jointed quadrilateral is so mounted, pivotably and displaceable in an approximately horizontal guide extending from the rear forwardly, that the suction head is displaceable around the forward end face of the tabletop into a not-in-use position located beneath the tabletop, in which position the suction head is parked in a not-in-use position which does not interfere with the work station.

Although the known configuration has proved to be viable, it is of a complex and delicate construction, whereby furthermore a positioning of the suction head in its in-use position is difficult.

The object of the invention is to simplify and make more stable, and to improve functionally, the construction of a worktable of the kind indicated in the introduction.

This object is achieved by the features of claim 1.

With the configuration according to the invention the suction head is held at the forward end of an approximately horizontally arranged carrier arm which is so adjustable or displaceable in a particular guide arrangement—both between a rearward and a forward adjustment position and simultaneously between a lower and an upper adjustment position—that the suction head is adjustable between an in-use position located above the working surface and a not-in-use position located beneath the working surface. Thereby the first and second guides in accordance with the invention prove to be advantageous not only with regard to the simple construction striven for but also for ergonomic reasons with regard to the guide path, whereby there is provided a construction for the guide arrangement which is stabilised and which can bear load. Furthermore, the guide arrangement in accordance with the invention makes possible an adjustment of the suction head with relatively little application of force, whereby also a simple, ready and stable positioning of the carrier arm in the in-use position of the suction head can be achieved.

The invention also relates to improvement of the worktable with regard to useability of its working device or tool, in particular to adapt to different working heights. This is achieved by means of a configuration in accordance with claim 11.

Further, configurations are proposed which ensure safe working, and working protective of the surroundings, at the work station of the worktable. For this there serves a transparent sheet which separates the work station needed in each case forwardly from the operating side of the worktable and thus protects in particular the head of the person working at the worktable. This work region may be reached into from both sides with the hands, e.g. to be able to carry through machining work, in particular grinding work, in a protected manner. In the forwardmost position of the protection sheet this is located in front of the working device, in particular a suction head. The protection sheet is held at a holder located above the work station, which holder is so moveable that the protection sheet can be adjusted further to the rear, i.e. also behind the working device and preferably is capable also of following an upright displacement of the working device or is moveably with its lower edge against the table surface whereby the working region desired in each case can be moved rearwardly and forwardly. This is in particular of advantage when work is to take place not on the working device but on the table surface.

With this configuration, the surroundings of the working region, at least to the fore, can be protected from contamination and dangers and thus it is suitable in particular for machining work, in particular grinding work. In order to protect also the surroundings to the rear of the working region it is advantageous to arrange on the worktable a rear sheet spaced from the forward sheet, which rear sheet can preferably be held in one and the same holder. By these means it is possible to arrange a forwardly and rearwardly bounded work station on the worktable, preferably adjustably.

With the present configuration the adjustability of the forward sheet is ensured by means of a pivoting of the holder around a horizontally and transversely running pivot axis. Thereby, it is advantageous to mount the rear sheet, which may be of transparent or non-transparent material, on the holder pivotably around a likewise horizontal transversely running pivot axis. This configuration makes possible not only a variation of the work station with regard to its depth dimension but it is also possible to pivot the rear sheet with the lower edge against the table surface, whereby the work space bounded between the sheets is sufficiently tightly bounded. It is also of advantage to arrange the holder, for the forward or for both sheets, moveably between a forward and a rearward end position, so that the working region (forward protection sheet) or the work space (forward and rearward protection sheet) can be moved between a forward and a rearward position. This can be realised in that the holder is arranged on a carrier arm or is formed by this carrier arm, which is correspondingly adjustable.

Figure 2:
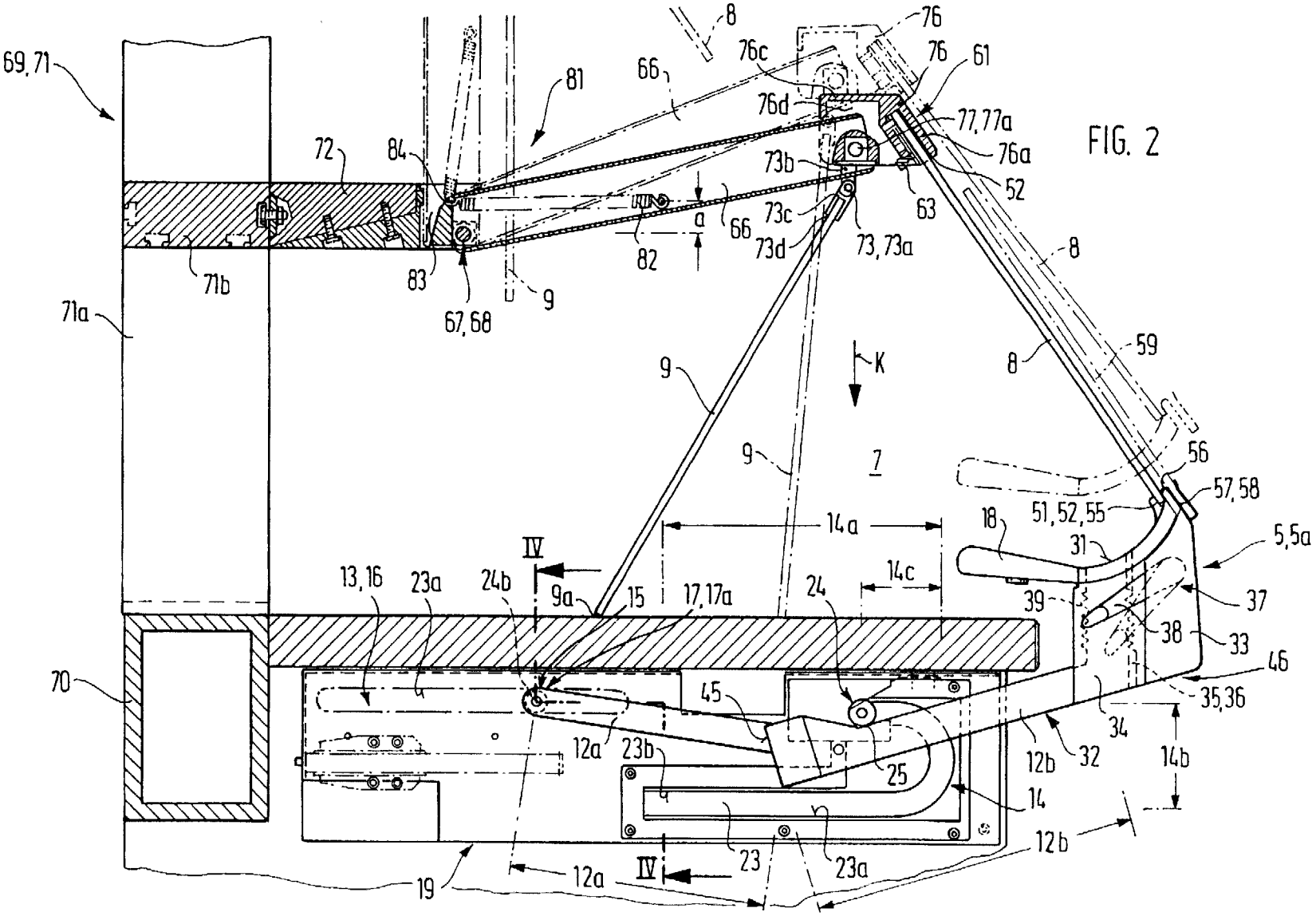
Figure 3:
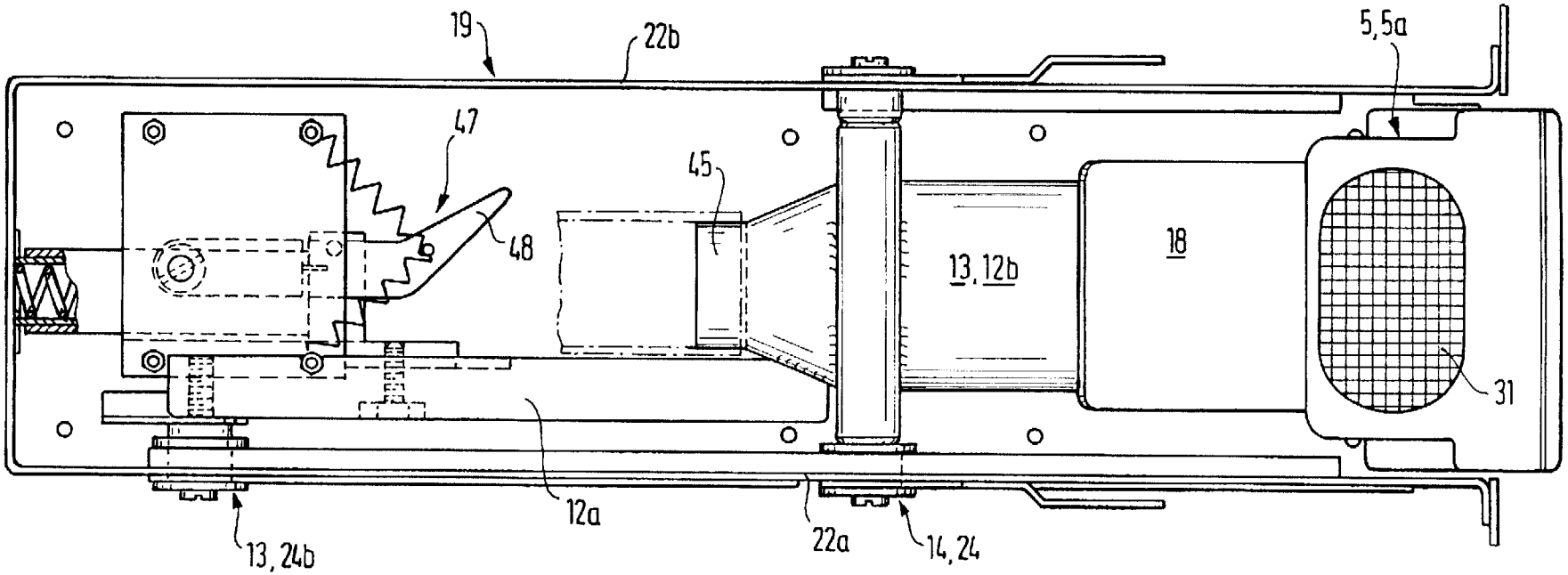
Figure 4:
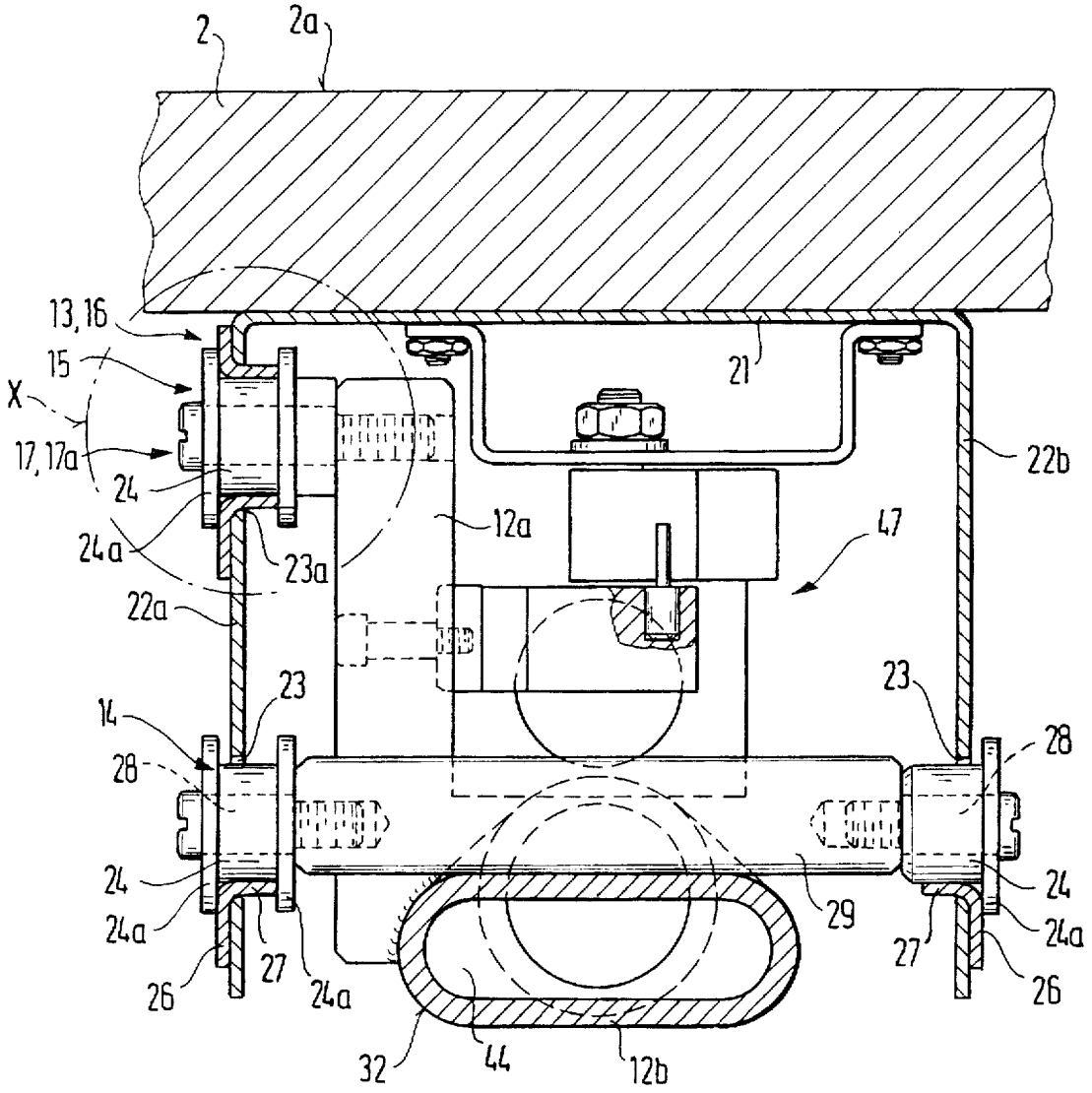

Below, the invention and further advantages which can be achieved thereby will be described in more detail with reference to preferred exemplary embodiments and the drawings, which show:

FIG. 1 a worktable in accordance with the invention, in perspective view;

FIG. 2 a partial section of the worktable, running vertically at right-angles to the operating side of the worktable, in a representation to a larger scale;

FIG. 3 a suction head with associated carrier arm as movable component, in a view from above;

FIG. 4 the section III—III of FIG. 2.

The worktable, generally designated by 1, consists of a tabletop 2 with and upper table surface 2*a*, two lateral continuous block-like table legs 3, in which drawers or cupboards accessible from the front side are arranged and between which there is present a free space for the legs of the of the person (not shown) working at the worktable 1, a working device 5 which is arranged in the middle region of the tabletop 2 at its forward edge and which is displaceable between an in-use position located above the table surface 2*a* and a not-in-use position pushed in under the tabletop 2, and a protection device 6 for a work station 7 including the working device 5 or arranged therebehind on the tabletop 2 having a forward protection sheet 8 and preferably also a rearward protection sheet 9 of transparent material such as glass or plastics, which are arranged on a holder arrange above the tabletop 2 and are preferably displaceable between a forward and a rearward working position.

The working device 5, formed by a working head or a suction head 5a, is arranged at the forward end of a carrier arm 12 extending below the tabletop 2, which arm is so guided in a horizontal longitudinal guide 13 and a vertical guide 14 that can be displaced out of its not-in-use position located under the tabletop 2 first forwardly, then upwardly around that forward edge of the tabletop 2 and then slightly rearwardly into the in-use position located above the tabletop 2, and can be displaced back again. The longitudinal guide 13 is a horizontal straight guide with a slider 15 which is freely displaceable in a guide detent 16 with slide or roller surfaces, between a rearward and a forward position. The rear end of the carrier arm 12 is, in a joint 17 having a transversely and horizontally running joint axis 17a, vertically pivotably connected with the slider 15 or is vertically pivotably mounted in the guide detent 16. The length of the carrier arm 12 is so great that in the forward end position of the longitudinal guide 13 a bearing plate 18, in particular of wood, projecting rearwardly from the suction head 5a in its upper region, is moveable with its rear end in the above-described manner around the forward edge of the tabletop 2.

The vertical guide 14 is a curved guide in the form of a runner having a longitudinal guide section 14a extending from the rear end of the guide initially horizontally and straight, a vertical guide section 14b adjoining thereon and curved upwardly, in particular curved in the form of a circular arc through 180°, and preferably a further vertical guide 14c extending from the latter approximately horizontally and to the rear and which may be of small guide length and in the present embodiment is a few centimeters.

The carrier arm 12 is of a rear carrier arm section 12a and a forward carrier arm section 12b which may each extend straight and include an obtuse angle open upwardly, in this case an angle of about 150°.

As FIG. 2 in particular shows, the guides 12, 13 are integrated in a common block-like guide box 19 which is attached to the underside of the tabletop 2, e.g. by means of screws. As can be seen from FIG. 4, the guide box 19 has an upper base wall 21 and two side walls 22a, 22b projecting downwardly from the base wall, in which side walls the vertical guide 14 is formed as respective corresponding like-formed grooves 23. The carrier arm 12 is guided in the grooves 23 by means of two guide rollers 24 the diameter of which is adapted to the width of the groove with play for movement, so that the bounding surfaces 23a, 23b of the groove 23 form guide surfaces on which the guide rollers 24 roll. At the forward and upper end of the vertical guide 14 a small depression or hollow 25 is worked into the (there) lower bounding surface 23b, into which depression or hollow the guide rollers 24 sink in. By these means, a so-called latch point is formed out of which the carrier arm 4 can be pulled out by means of a pull to the front and the application of slight force. In this forward guide end position the suction head 5a is directly before the tabletop 2 whereby the bearing plate 18 projects rearwardly of the table surface 2a at a small vertical spacing. As in particular FIG. 3 shows, for improving working life, angle pieces 26 having a vertical and a horizontal limb may be so placed in the grooves 23 that in each case at least the lower bounding surface is formed by means of the horizontal limb 27 which preferably is of a wear resistant material. With such an arrangement, in consideration of the thickness of the horizontal limb or limbs 27, the width should be made larger so that the guide rollers 24 fit therein. The angle pieces 26 may be attached to the side walls 22a, 22b with their vertical limbs.

The guide rollers are freely rotatably mounted on an axis 28 which is attached to the carrier arm 12, here in the rear region of the carrier arm section 12b, preferably on a one-piece component 29 (see FIG. 4) attached—preferably welded—to the upper side of the carrier arm 12b. At least one guide roller 24 has a reel-like body with two end flanges 24a for the side walls 22a, 22b or the limb 27, whereby a lateral guiding is afforded.

In corresponding manner the longitudinal guide 13 may be formed with a groove 23a and lower—or also upper—angle pieces 26a arranged therein, in one side wall 22a or in both side walls 22a, 22b, and with guide rollers 24b running therein, see detail X in FIG. 4.

In the not-in-use position pushed back under the tabletop 2 the suction head 5a is located at least partially between the side walls 22a, 22b, between which it can be pushed in.

The suction head 5a has a suction opening 31 directed upwardly and preferably at the same time obliquely rearwardly directed, which in the present embodiment is concavely rounded in order to fulfil the mentioned directional features, and which is closed off by a grid or the like in order to prevent the sucking in of small parts. A suction line 32 extends from the suction opening 31 downwardly and rearwardly to a filter device (not shown) which may be an individual device associated with the worktable 1 or may be a collective device for several worktables or suction devices.

In the present embodiment, the suction head 5a is approximately vertically moveable or telescopable, i.e. adjustable in height not only by means of its carrier arm 12 but also in itself, independently of the carrier arm. For this purpose the suction head 5a is formed of a plurality of parts with a moveable suction head part 33 and a fixed suction head part 34, of which the latter is arranged preferably rigidly on the forward end of the carrier arm 12 and the moveable suction head part 33 has an upright slider 35 which is vertically displaceable in a guide part 36 projecting upwardly from the lower suction head part. For fixing in the respective displaced position of the upper suction head part 33 there is a fixing device 37 with a manually actuable fixing part, here in the form of a lever 38, which with rotational actuation acts on a clamping part (not shown), for example in the form of an eccentric or a screw part and fixedly clamps the slider 35 on the guide part 36. In the present embodiment, the lever 38 is arranged to the side in a downwardly projecting position.

The suction line 32 extends through the upper and lower suction head parts 33, 34 as a length-adjustable hose or bellows 39 which is attached between a pipepiece on the upper and lower suction head part 33, 34 and is located in a free space between the upper and the lower suction head part 33, 34 which space receives the line. The lower pipepiece is the forward end of a suction channel 44 which extends through the carrier arm 12, here the forward carrier arm section 12b, whereby the latter is preferably formed by a pipe, here a flattened pipe of oval cross-section, which has at its rear end a pipepiece 45 for the connection of a further length-adjustable hose or bellows (not shown), which forms a further part of the suction line. As shown in particular by FIG. 3, the rear carrier arm section 12a is attached to a side of the thus formed pipe, e.g. welded on. Thereby, the obtuse angled arrangement of the carrier arm sections 12a, 12b proves to be advantageous particularly in the upper adjustment position, in order to provide thereabove free space for other components.

The displaceable unit 46, formed by the suction head 5*a* and the carrier arm 12, has associated with it an ejection assistor device 47 such as is in principle per se known for drawers and lids. This assistor device 47 is arranged in the rear region of the guide box 19 and it has a pressure part 48 which is adjustable longitudinally of the movement direction of the unit and biassed by a spring (not shown) in the ejection direction of the unit, when upon insertion of the unit a contact part at the rear end of the rear carrier arm part 12*a* pushes in the pressure part 48 rearwardly by a certain path length, whereby the pressure part latches in this insertion position. By means of a second exercise of pressure, with a certain application of force in the insertion direction, the pressure part 48 can be inserted a further distance whereby the above-mentioned latching is released and the pressure part 48, by means of its spring force, after the unit 46 has been let go, pushes out the unit by a certain amount, e.g. a few centimeters, beyond the insertion end position, so that the suction head 5*a* can be readily grasped with the hand and drawn out further forwardly.

At the forward upper edge of the working device 5 or of the suction head 5*a* there is provided a holder 51, preferably in the form of a plug-in holder 52 open on the upper side, for the forward protection sheet 8 which covers and thus protects the work region 7 forwardly. The plug-in holder 52, preferably formed by means of a groove 55 extending horizontally and transversely, and the protection sheet 8, extend preferably obliquely upwardly to the rear. The holder 51 may also be formed as a clamping holder, with a spring arm 56 which laterally clamps the protection sheet 8 in the plug-in holder 52.

With the present embodiment, such a first holder 51 is provided with a first groove 55, into which the protection sheet 8 can be inserted from above, and a second holder 57 in the form of a groove 58 open on the upper side and displaced to the rear relative to the first groove 55, which serves as a support device for the same or a further protection sheet 59.

The protection sheet 8 may be attached, releasably or non-releasably, for example by means of at least one clamping screw 63, at a holder 61 arranged above the tabletop 2 or the work station 7, in a plug-in holder or a downwardly open groove 52. The holder 61 is so arranged that the protection sheet 8 is adjustable on the one hand between a rear position—shown in the drawings—in which the it is located before the suction opening 31 or the working device 5, and a position in which it is located behind the suction opening 31 or the working device 5, so that the depth or the forward boundary of the work station 7 is moveable. On the other hand the holder 61 is arranged adjustable in height so that the protection sheet 8 is able to follow the upright movement of the upper suction head part 33, or is adjustable to the latter, as is shown in FIG. 2.

The above-described adjustability of the protection sheet 8 can be realised also by means of an adjustability of the holder 61 supported on a stand in the rear region of the worktable 1, whereby the holder 61 is adjustable in height and/or is adjustable in its depth or its spacing from the forward operating side. For the latter purpose, there may serve a holder arm 66 for the holder 61 which is telescopable in various ways. In the present embodiment, the holder arm 66 is a holder arm 66 extending from the rear forwardly which at its rear end is connected, by means of a joint 67 having a horizontally and transversely running joint axis 68, directly or indirectly, with a carrier 69 which is attached in the rear edge region of the table surface 2*a* on the worktable 1. The carrier 69 may be a stand or carrier rod extending upright. In the present embodiment the carrier 69 is formed by means of a carrier frame 71 having two vertical side rails 71*a* and a horizontal cross-rail 71*b* connecting the side rails together, whereby the joint 67 is preferably arranged on the cross-rail 71*b*. Further, the joint 67 is preferably attached on a forward attachment 72 and thus arranged at a spacing to the fore from the carrier frame 71 or stand. The stand or carrier frame 71 is preferably attached to a hollow box profile, preferably of metal, which is let into the worktable 1 to the rear and serves as an installation track receiving diverse electrical and pneumatic lines.

As FIG. 2 shows, the rearward protection sheet 9 is likewise held on the holder 61, whereby the sheet is preferably held freely pivotably on the holder 61 in a joint 73 having a horizontal transverse axis 73*a*. The joint 73 is of a first joint part 73*b*, projecting from the holder 61 downwardly, and a second joint part 73*c*, holding the rearward protection sheet 9 and having a groove 73*d*, open downwardly, into which the rearward protection sheet 9 is inserted with its upper edge region and is fastened therein, e.g. by gluing. The rearward protection sheet 9 is preferably somewhat higher than the forward protection sheet 8, whereby account is taken of the spacing at which the suction head 5*a* is located above the table surface 2*a* in its in-use position. Thereby, the rearward protection sheet 9 is so high that its lower edge 9*a* in the lower in-use position shown in FIG. 2 with solid lines lies on the table surface 2*a* in an oblique position, directed rearwardly obliquely downwardly, and in the upper in-use position lies on the table surface 2*a* in a less oblique position, as is shown in FIG. 2 with chain lines.

Between the two protection sheets 8, 9, a work space is defined above the work station 7 which is open to both sides so that not only can the hands of the person working at the worktable 1 reach therein from both sides but also so that air can flow to the suction head 5*a*.

Further, it is advantageous to hold at least the forward protection sheet 8 and preferably also the rearward protection sheet 9 at a holder head 76 which is pivotally connected with the holder arm 66 by means of a joint 77 having a joint axis 77*a* running horizontally and transversely. By these means the adaptability in particular of the forward protection sheet 8, and also of the rearward protection sheet 9, to the suction head 5*a* and to the table surface 2*a* is improved. Further, at least the forward protection sheet 8 can be positioned in a position located behind the suction head 5*a* on the table surface 2*a*also with a suction head 5*a* pushed back into its out-of-use position. Thereby, the rearward protection sheet 9 can on the one hand follow the forward protection sheet 8 dependently by reason of its arrangement on the holder head 76 and on the other hand independently by reason of its mounting in the joint 73. Thus, not only the forward boundary of the work station 7 or of the work region be varied in depth by means of the forward protection sheet 8 but also the working space as a whole.

The holder head 76 preferably has a cap-like form with a forward wall 76*a* which in particular extends obliquely downwardly and on which the forward protection sheet 8 is held releasably or non-releasably preferably in the groove 52, a ceiling wall 76*c* and two side walls 76*d* whereby the forward end of the holder arm 76 is covered in a cap-like manner.

The holder head 76 may also be formed as a head strip 76*e* extending in an elongate manner approximately over the upper edge lengths of the protection sheets 8, 9 which strip is schematically indicated in FIG. 1 and closes off the upper gap between the protection sheets 8, 9.

The holder 61 is preferably provided with a relief device 81 for its weight, so that it can be more easily be adjusted vertically or horizontally (transverse to the operating side). For this purpose there serves a spring 82 which is so arranged between the stand or carrier frame 71—here the attachment 72—and the holder arm 66, that a turning moment exerted thereby on the holder arm 66 in lower positions is greater than in higher positions, whereby the force K of the holder 61—resulting from its effective own weight and directed downwardly—is counteracted so that the holder can be readily adjusted by hand. The tension spring 82 is, in the illustrated in-use position of the holder 61, in a position located at a spacing a above the joint 67 between the carrier frame 71 or attachment 72 or an attachment 83 to the same, and is spanned to the holder arm 66 at a location 84 which is located on the one hand in the longitudinal middle of the holder arm 66 and on the other hand above the joint 67. In this position, a bolt may be provided on which the tension spring 82 is hung. In the upwardly pivoted not-in-use position of the holder 61, which is shown in FIG. 2 likewise in broken line—but not completely—the rearward protection sheet 9 is located in a position hanging freely downwardly near to the upwardly directed holder arm 66, whereby the forward protection sheet 8 stands obliquely downwardly with a position in which it does not interfere with the work station 7.

We claim:

1. Worktable (1) for a medical or dental laboratory, having a work station (7) on a forward region of a tabletop (2) of said worktable, at which a working device (5) is arranged, said working device being movable on a guide framework (12, 13, 14) mounted on said worktable between an in-use position located above the tabletop (2) and a not-in-use position located under a table surface (2*a*) of said tabletop, wherein the guide framework has a telescopable carrier arm (12) arranged under the tabletop (2) extending approximately horizontally, said arm having a rear portion mounted on the worktable (1) so as to be pivotable around a pivot axis (17*a*) extending horizontally and transversely of the worktable, and a guide element (24) contacting a forward portion of said carrier arm at a spacing forwardly from the pivot axis (17*a*), said mounted on said worktable guide element being displaceably guided in a guide path (14) that extends from a rear guide path end initially extending approximately horizontally (14*a*) forwardly and then curvedly upwardly (14*b*), the guide element (24) being positionable in an upper region of the guide path such that the carrier arm (12) is selectively telescopable in a region between the pivot axis (17*a*) and the guide element (24) or is guided at the rear end thereof in a further, horizontally extending guide (13, 16) mounted on said worktable.

2. Worktable according to claim 1, wherein a horizontally rearwardly extending upper guide path section (14*c*) joins the upwardly curving guide path section (14*b*) at an upper end thereof.

3. Worktable according to claim 2, wherein in the in-use position of the working device (5) a depression (25) in the rearwardly extending guide path section (14*c*) has the carrier arm (12) latched with its guide element (24) located therein.

4. Worktable according to claim 1, wherein a transition between the forwardly extending guide path section (13) and the upwardly curving guide path section (14), a transition between the upwardly curving guide path section and the rearwardly extending guide path section is curved in the shape of an arc of a circle.

5. Worktable according to claim 1, wherein the carrier arm (12) has the rear end portion thereof displaceably mounted by a guide roller (24*a*) in the approximately horizontal guide (13) which is formed by a groove (23) in a structure fastened to the worktable.

6. Worktable according to claim 1, wherein the guide path sections (13, 14) are arranged on opposite sides of the carrier arm (12).

7. Worktable according to claim 1, wherein the guide path sections (13, 14) are formed by respective grooves, the carrier arm (12) being displaceable in each said respective groove thereof a conveying or rolling said guide element (24).

8. Worktable according to claim 1, wherein the guides (13, 14) are respectively arranged in at least one upright lateral side walls (22*a*, 22*b*) of said worktable, which is arranged under the tabletop (2) and is attached to the underside thereof.

9. Worktable according to claim 1, wherein in the not-in-use of the working device (5) an ejection assistor device (47) comprising lever means interconnecting the carrier arm (12) and working device is released by manual pressure against the working device (5) in the insertion direction and which at least partially ejects the working device (5) from the worktable.

10. Worktable according to claim 9, wherein the guide path sections (13, 14) and a further guide (16) and the ejection assistor device (47) are integrated in an attachment unit of box-like form which is attached to an underside of the tabletop (2).

11. Worktable (1) for a medical or dental laboratory, having a work station (7) on a forward region of a tabletop (2), a working device (5) being arranged so as to be moveable on a guide framework (12, 13, 14) fastened to said worktable between an in-use position located above the tabletop (2) and a not-in-use position arranged under the table surface (2*a*), wherein the working device (5) consists of a working device head (5*a*) and a working device base (5*b*), means mounting the working device head so as to be displaceable upwardly on the base in a guide (35, 36) and fixable in the respective position.

12. Worktable according to claim 11, wherein the work station (7) has a forward protection sheet (8; 9) operatively associated therewith which is held at a holder (61) arranged above either the work station (7) or at the working device (5).

13. Worktable according to claim 12, wherein the forward protection sheet (8) is held on the holder (61) so as to be adjustable in height and to be pivotable around a horizontal axis (77*a*) extending transversely though the worktable.

14. Worktable according to claim 12, wherein a rear protection sheet (9) is provided at a rearwardly directed spacing from the forward protection sheet (8), which rear protection sheet (9) is held at the holder (61) pivotable movable around a horizontal transverse axis (73*a*).

* * * * *